United States Patent [19]

Taylor

[11] Patent Number: 5,025,819

[45] Date of Patent: Jun. 25, 1991

[54] UMBRELLA SLING APPARATUS

[76] Inventor: Adrienne H. Taylor, R.R.-5 Box 360, Montpelier, Vt. 05602

[21] Appl. No.: 560,351

[22] Filed: Jul. 30, 1990

[51] Int. Cl.[5] ..... A45B 3/00

[52] U.S. Cl. ..... 135/16; 2/86; 2/338; 224/258; 224/915; 242/107

[58] Field of Search ..... 135/20 R, 37; 2/338, 2/89, 86; 294/150, 149, 152; 224/915, 258, 913, 202, 257; 242/107

[56] References Cited

U.S. PATENT DOCUMENTS

| | | | |
|---|---|---|---|
| 2,166,652 | 7/1939 | Staley . | |
| 2,551,963 | 5/1951 | Myers . | |
| 2,931,629 | 4/1960 | Keller | 294/149 X |
| 2,993,661 | 7/1961 | D'Arrigo | 242/104 X |
| 3,279,663 | 10/1966 | Torres | 224/915 X |
| 3,495,770 | 2/1970 | Seltmann, Jr. et al. | 224/913 X |
| 4,165,073 | 8/1979 | Konig | 242/107.1 |
| 4,249,686 | 2/1981 | Morwood | 224/913 X |
| 4,440,334 | 4/1984 | Kappell et al. . | |
| 4,529,240 | 7/1985 | Engel | 294/150 X |
| 4,562,945 | 1/1986 | Erlandson . | |
| 4,610,476 | 9/1986 | Keiner | 294/149 |
| 4,773,577 | 9/1988 | Mikula . | |
| 4,907,614 | 3/1990 | Stamm | 135/20 R |
| 4,930,533 | 6/1990 | Allen | 135/20 R |

FOREIGN PATENT DOCUMENTS

| | | | |
|---|---|---|---|
| 38520 | 3/1928 | Denmark | 294/149 |
| 1472627 | 3/1967 | France | 2/338 |
| 24435 | of 1911 | United Kingdom | 224/915 |

*Primary Examiner*—David A. Scherbel
*Assistant Examiner*—Lan Mai
*Attorney, Agent, or Firm*—Leon Gilden

[57] ABSTRACT

An apparatus as set forth including an elongate flexible sling member, including an upper terminal end mounted to a support rod tip projecting coaxially of the support rod extending beyond an associated umbrella canopy. The lower terminal end of the sling is mounted to a lower terminal end of the support rod adjacent a handle of an associated umbrella structure. The sling member includes an adjusting sleeve defining a loop of the elongate sling member to effect elongate adjustment of the sling to permit securement of the associated umbrella about a torso portion of an associated individual transporting the umbrella. A modification of the invention includes the lower terminal end of the sling member wound about a spring-biased drum to retractably secure the sling member within a housing. Further, an elongate support web selectively secures a water repellent jacket within a cavity of the web, wherein the web is mounted to the support rod tip and a projecting canopy spine member of the associated canopy.

1 Claim, 4 Drawing Sheets

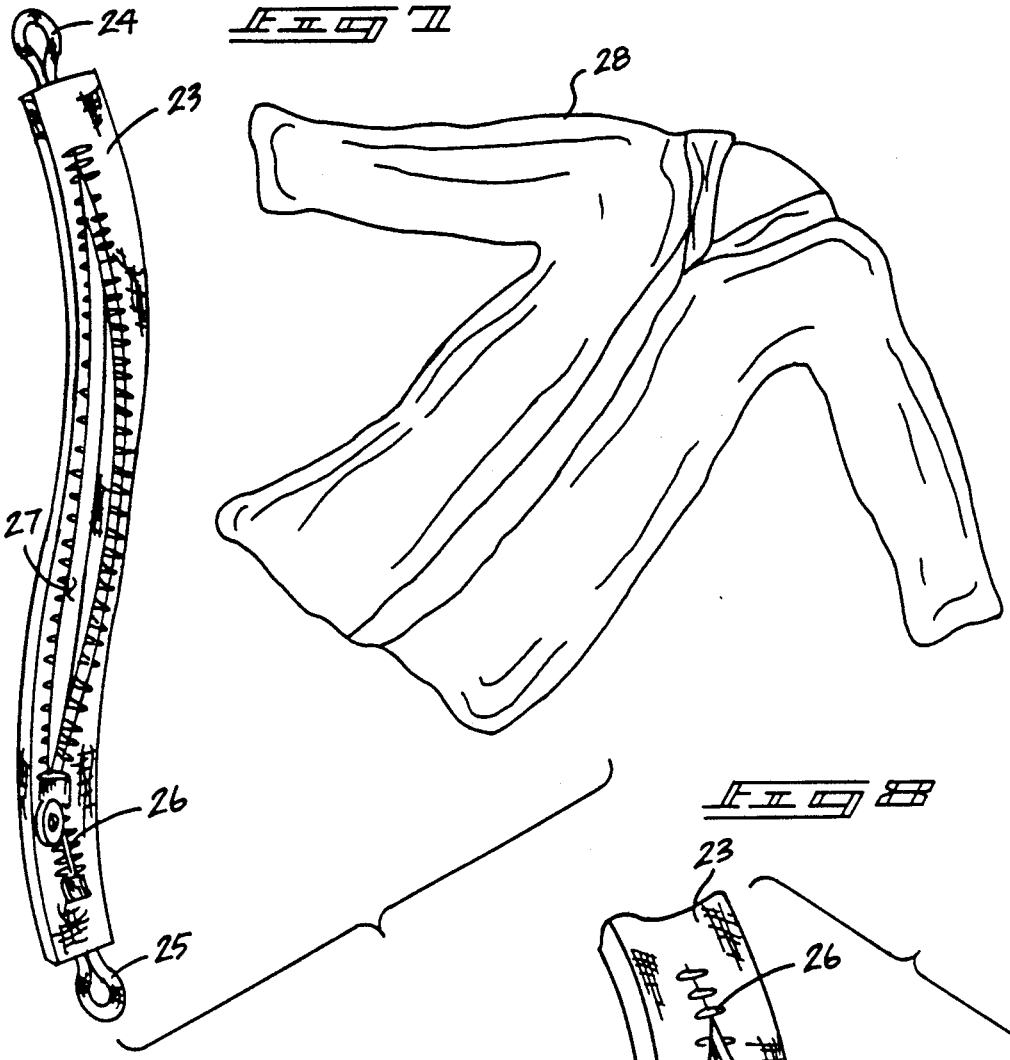
FIG 7
FIG 8
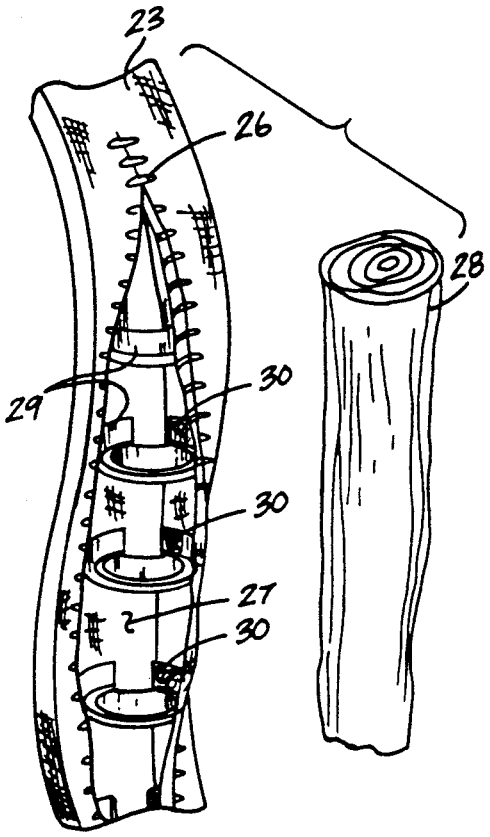

UMBRELLA SLING APPARATUS

BACKGROUND OF THE INVENTION

1. Field of the Invention

The field of invention relates to umbrella structure, and more particularly pertains to a new and improved umbrella sling apparatus in combination with an umbrella to permit ease of transport of the umbrella during periods of non-use.

2. Description of the Prior Art

Transport of an associated umbrella is frequently of an inconvenient event, as the umbrella during periods of non-use can be a relatively awkward structural component to be transported, particularly when an individual is engaged in the transport of various other articles. To enhance ease of transport and adjustment of such a sling structure in combination with an umbrella, the instant invention provides an adjustable sling member that is mounted adjacent opposed terminal ends of the umbrella for ease of transport thereof. Prior art support structure may be found in U.S. Pat. No. 2,551,963 to Myers wherein an elongate web is mounted coaxially through an umbrella defining a shank of the umbrella.

U.S Pat. No. 2,166,652 to Staley provides an umbrella with a generally handle structure to permit securement of the handle to a perimeter edge of an associated container during transport by an individual.

U.S. Pat. No. 4,773,577 to Mikula sets forth a fireman's ax, with sling structure mounted adjacent opposed terminal ends of the handle of the fireman's ax.

U.S. Pat. No. 4,440,334 to Kappell, et al. set forth a camera strap construction with swivel hooks mounted at each end of the strap and an adjustable lock mounted medially of the strap for adjustment of the strap.

U.S. Pat. No. 4,562,945 to Erlandson sets forth a gun sling for securement adjacent opposed ends of an associated firearm adjustable medially of the sling structure to effect length adjustment of the sling.

As such, it may be appreciated that there continues to be a need for a new and improved umbrella sling apparatus wherein the same addresses both the problems of ease of use as well as effectiveness in compactness of construction and in this respect, the present invention substantially fulfills this need.

SUMMARY OF THE INVENTION

In view of the foregoing disadvantages inherent in the known types of umbrella apparatus now present in the prior art, the present invention provides an umbrella sling apparatus wherein the same permits adjustment of a sling in association with an umbrella for ease of transport of the umbrella during periods of non-use. As such, the general purpose of the present invention, which will be described subsequently in greater detail, is to provide a new and improved umbrella sling apparatus which has all the advantages of the prior art umbrella apparatus and none of the disadvantages.

To attain this, the present invention provides an apparatus setting forth an elongate flexible sling member, including an upper terminal end mounted to a support rod tip projecting coaxially of the support rod extending beyond an associated umbrella canopy. The lower terminal end of the sling is mounted to a lower terminal end of the support rod adjacent a handle of an associated umbrella structure. The sling member includes an adjusting sleeve defining a loop of the elongate sling member to effect elongate adjustment of the sling to permit securement of the associated umbrella about a torso portion of an associated individual transporting the umbrella. A modification of the invention includes the lower terminal end of the sling member wound about a spring-biased drum to retractably secure the sling member within a housing. Further, an elongate support web selectively secures a water repellent jacket within a cavity of the web, wherein the web is mounted to the support rod tip and a projecting caopy spine member of the associated canopy.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms for phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved umbrella sling apparatus which has all the advantages of the prior art umbrella apparatus and none of the disadvantages.

It is another object of the present invention to provide a new and improved umbrella sling apparatus which may be easily and efficiently manufactured and marketed.

It is a further object of the present invention to provide a new and improved umbrella sling apparatus which is of a durable and reliable construction.

An even further object of the present invention is to provide a new and improved umbrella sling apparatus which is susceptible of a low cost of manufacture with regard to both materials and labor, and which accordingly is then susceptible of low prices of sale to the consuming public, thereby making such umbrella sling apparatus economically available to the buying public.

Still yet another object of the present invention is to provide a new and improved umbrella sling apparatus which provides in the apparatuses and methods of the prior art some of the advantages thereof, while simultaneously overcoming some of the disadvantages normally associated therewith.

Still another object of the present invention is to provide a new and improved umbrella sling apparatus wherein the same permits ease of transport in securement of an umbrella during periods of non-use.

These together with other objects of the invention, along with the various features of novelty which characterize the invention, are pointed out with particularity in the claims annexed to and forming a part of disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the support web of the instant invention and associated contents thereof in an unfurled configuration.

FIG. 8 is an isometric illustration of the instant invention illustrating details of the cavity construction of the web utilized by the instant invention.

DESCRIPTION OF THE PREFERRED EMBODIMENT

Figure 1:
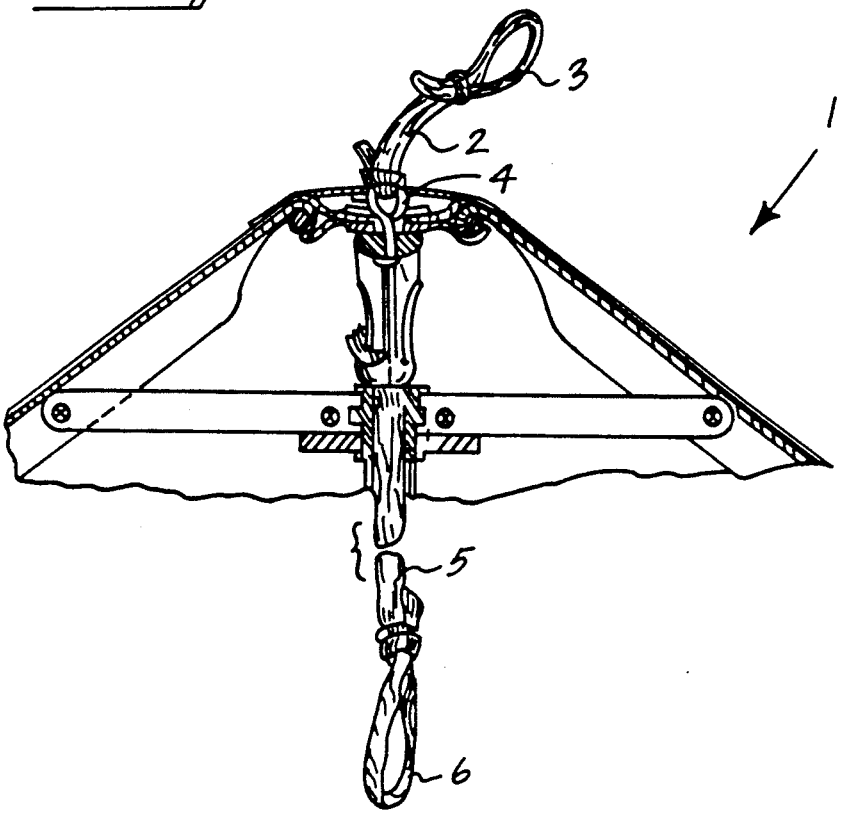
FIG. 1 is an orthographic cross-sectional illustration of a prior art umbrella support structure.

With reference now to the drawintgs, and in particular to FIGS. 1 to 8 thereof, a new and improved umbrella sling apparatus embodying the principles and concepts of the present invention and generally designated by the reference numeral 10 will be described.

FIG. 1 illustrates a prior art umbrella support structure 1, wherein an upper web member 2 is mounted to a hook portion 4 terminating in an upper loop 3, with a lower web member 5 including a lower loop 6 to permit ease of transport of the umbrella, as set forth in U.S. Pat. No. 2,551,963.

Figure 2:
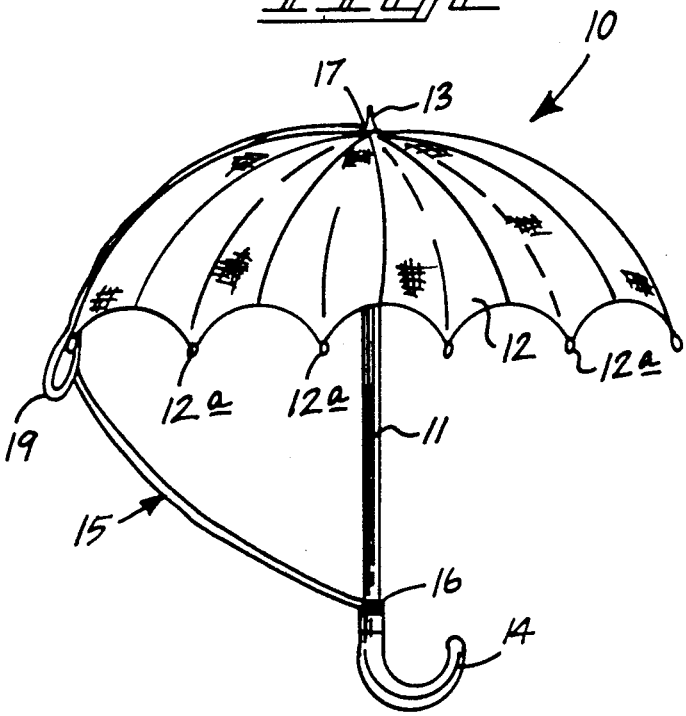
PRIOR ART FIG 2
FIG. 2 is an isometric illustration of the the instant invention.
Figure 3:
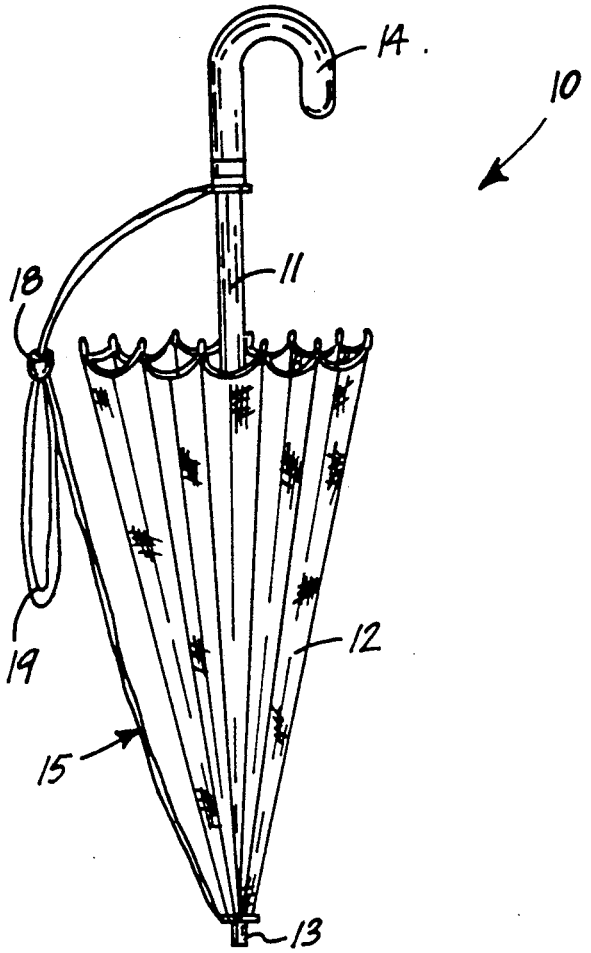
FIG. 3 is an orthographic side view, taken in elevation, of the instant invention.
Figure 4:
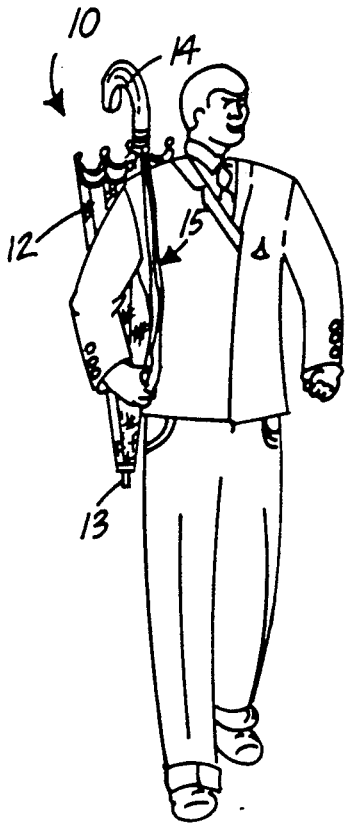
FIG. 4 is an orthographic view, taken in elevation, of the instant invention for transport by an individual.

More specifically, the umbrella sling apparatus 10 of the instant invention essentially comprises an elongate longitudinally aligned support rod 11, including an umbrella canopy 12, including a hemispherical array of canopy spine members **12*a* to support the canopy 12 in an opened configuration for example as set forth in FIG. 2. The support rod 11 includes a support rod tip 13 coaxially aligned with the support rod projecting beyond the umbrella canopy 12. A handle 14 is integrally mounted to a lower terminal end of the support rod 11, as illustrated. A sling member 15 defined by an elongate flexible line member includes a lower terminal end portion 16 mounted to the lower terminal end of the support rod adjacent the handle 14, with the sling member upper terminal end portion 17 typically defined as a loop secured about the support rod tip 13 of the umbrella structure. Reference to FIG. 3 illustrates the use of an adjusting sleeve 18 formed with a through-extending bore to permit directing of the sling member 15 therethrough to define an adjustable loop 19 that is adjustable dependent upon the longitudinal extent of the loop 19 to effect an adjustment of the sling 15 for convenience of transport by an individual, in a manner as illustrated in FIG. 4**.

Figure 5:
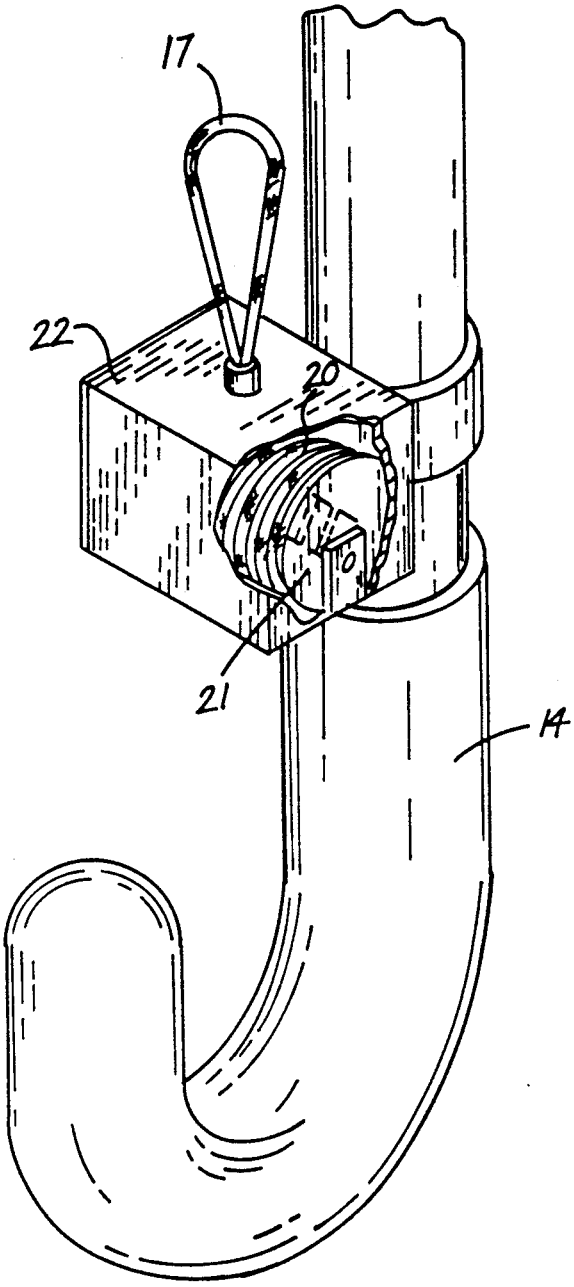
FIG. 5 is an isometric illustration, partially in section, of a modified lower terminal end mounting of the sling of the instant invention.
Figure 6:
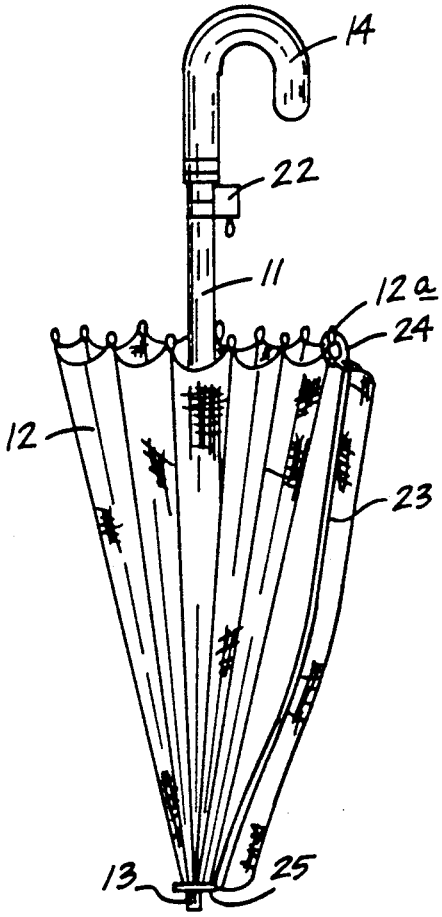
FIG. 6 is an orthographic view, taken in elevation, of the instant invention including a support web mounted to an associated umbrella.

FIG. 5 illustrates the lower terminal end portion 16 in a sling 15, including a housing 22 mounting a support drum 21 with a spring-biased axle directed medially of the drum to effect retraction of the flexible line 20 about the support drum 21. The sling member upper terminal end portion 17 defined as a loop is normally retracted within the housing 22 in a first biased position and extended therefrom for use and positioning about the support rod tip 13. FIG. 6 illustrates the further use of a support strap web 23, including an upper loop 24 mounted about a projecting spine member **12*a* of the canopy 12 and a lower loop 25 mounted about the support rod tip 13. The support strap web 23 includes an elongate zipper 26 directed longitudinally of the web 23 to expose an elongate web cavity 27 defined coextensively and interiorly of the support web 23 when the zipper is in an opened configuration. Retractably secured within the web cavity 27 is a polymeric, water-repellent jacket 28 defined by a torso sleeve and an upper opening to permit securement about an individual for use during periods of rain and the like. The jacket 28 is normally in a furled configuration, as illustrated in FIG. 8, and secured within the web cavity 27. The web cavity 27 includes a series of parallel, equally spaced web securement loops 29 defined by split annular loop members, wherein the loops 29 each include hook and loop fastener end surfaces 30 to permit securement of the loop members together when the jacket 28 is secured within the loop members within the web cavity 27. When the jacket 28 is thusly secured, the zipper 26** is closed for subsequent use of a jacket as required by an individual.

As to the manner of usage and operation of the instant invention, the same should be apparent from the above disclosure, and accordingly no further discussion relative to the manner of usage and operation of the instant invention shall be required.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An umbrella sling apparatus comprising, in combination, an umbrella, the umbrella includes an umbrella canopy, the umbrella canopy defined by a semi-spherical array of spine members; wherein the spine members project beyond the the umbrella canopy to define a spine tip, and a support rod coaxially and medially mounted to the umbrella canopy at an upper terminal end of the support rod, including a support rod tip coaxially mounted to the support rod projecting coaxially beyond the umbrella canopy, and a lower terminal end of the support rod including a handle mounted integrally thereto, and a sling member, wherein the sling member includes a lower terminal end portion mounted to the support rod adjacent the handle, and the sling member including an upper terminal end, wherein the upper terminal end includes a loop for securement about the support rod tip, the sling member defined as an elongate flexible member, with an adjusting sleeve mounted medially of the sling member, with the adjusting sleeve including a through-extending bore receiving a medial portion of the sling member to define a loop, wherein the loop defines an adjustable length to effect adjustment of the sling member, and wherein the lower terminal end of the sling member includes a housing, the housing including a support drum, the support drum including a spring-biased axle mounted to the housing to bias the drum to a retracted position, with the sling mounted about the drum to normally retract the sling within the housing when the upper terminal end portion is removed from the support rod tip, and further including an elongate support strap web, the support strap web including an upper loop and a lower loop, the upper loop mounted to a spine tip, and the lower loop mounted about the support rod tip, and wherein the support strap web includes an elongate web cavity contained interiorly of the support strap web, and an elongate zipper formed coextensively of the support strap web to permit access to the elongate web cavity, and including a polymeric water-repellent jacket selectively securable within the elongate web cavity, the jacket including an elongate torso and sleeves for securement about an individual, and wherein the elongate web cavity includes a series of equally spaced web securement loops mounted within the elongate web cavity, the web securement loops defined by split annular loop members to permit reception of the jacket in a furled configuration, and wherein each of the securement loops include hook and loop fastener end surfaces at confronting ends of each of the securement loops for selective securement of each of the securement loops together to secure the jacket within the cavity.

* * * * *